US006199525B1

(12) United States Patent
Uema et al.

(10) Patent No.: US 6,199,525 B1
(45) Date of Patent: Mar. 13, 2001

(54) CAMSHAFT DRIVE FOR ENGINE

(75) Inventors: Hitoshi Uema; Yuichi Asano, both of Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/166,062

(22) Filed: Oct. 2, 1998

(30) Foreign Application Priority Data

Oct. 2, 1997 (JP) ..... 9-269486

(51) Int. Cl.[7] ..... F01L 1/02
(52) U.S. Cl. ..... 123/90.31; 123/90.27
(58) Field of Search ..... 123/90.27, 90.31

(56) References Cited

U.S. PATENT DOCUMENTS 4,841,789 * 6/1989 Ochiai ..... 74/15.63
4,993,374 * 2/1991 Okui ..... 123/90.31
5,024,287 * 6/1991 Okui et al. ..... 180/297
5,113,807 * 5/1992 Kobayashi ..... 123/41.74
5,724,930 * 3/1998 Sakurai et al. ..... 123/90.31
5,740,768 * 4/1998 Sakurai et al. ..... 123/90.27

FOREIGN PATENT DOCUMENTS 0335246 4/1989 (EP) .
0415022 3/1991 (EP) .

OTHER PUBLICATIONS

Patent Abstracts of Japan, vol. 10, No. 261, Sep. 5, 1986 & JP A 61 085510 A (Honda Motor Co Ltd), May 1, 1986.

* cited by examiner

*Primary Examiner*—Weilun Lo
(74) *Attorney, Agent, or Firm*—Knobbe, Martens, Olson & Bear, LLP

(57) ABSTRACT

A camshaft drive arrangement for an internal combustion engine wherein the drive includes first and second intermediate shafts journaled directly within the cylinder block. The first intermediate shaft is driven directly to the crankshaft and the second intermediate shaft is driven from the first intermediate shaft by a flexible transmitter drive. The second intermediate shaft drives a camshaft journaled in the cylinder head by a second flexible transmitter drive.

7 Claims, 4 Drawing Sheets

CAMSHAFT DRIVE FOR ENGINE

BACKGROUND OF THE INVENTION

This invention relates to a camshaft drive for an engine and more particularly to an improved camshaft drive arrangement for an overhead camshaft that permits a compact engine construction.

In substantially all engine applications, there is a large demand for more compact engine constructions. This is particularly true in connection with automotive applications. One particularly demanding situation in an automotive application is when the engine is positioned transversely in the chassis. Such transverse placement normally substantially limits the number of cylinders that can be used because of the length constraints.

Where overhead camshafts are employed, the camshafts are normally driven off of the crankshaft by a timing mechanism that is generally provided at one end of the crankshaft. Such arrangements have a number of difficulties, not the least of which is the fact that this type of a drive generally adds to the overall length of the engine.

There has been proposed, therefore, a type of camshaft drive where the camshaft is driven from an intermediate shaft which is in turn driven from the crankshaft. By doing this, it is possible to shorten the length of the crankshaft and, accordingly, the entire engine. In addition, since there are several stages in the drive from the crankshaft to the camshaft, it is possible to utilize smaller driving sprockets or pulleys in order to achieve the necessary two-to-one speed reduction between the speed rotation of the crankshaft and the camshaft. This further facilitates the formation of compact engine constructions.

An example of an engine having this type of construction may be found in U.S. Pat. No. 5,154,144 issued Oct. 13, 1992, and assigned to the assignee hereof.

Although this type of structure is quite advantageous, the intermediate shaft is mounted in the cylinder head and this tends to give rise to a rather bulky cylinder head arrangement. This may be best understood by reference to FIG. 1, which is a view showing this prior art type of engine camshaft driving arrangement. The arrangement shown in FIG. 1 is not exactly the same as that shown in the aforenoted issued United States Letters Patent, but the problems presented by it are evident from this figure.

As seen in this figure, an engine, shown partially with portions removed and other portions broken away, indicated generally by the reference numeral 11, is comprised of a cylinder block assembly 12 to which a cylinder head assembly 13 is detachably affixed in a known manner. The cylinder head assembly 13 includes a main cylinder head member 14.

In the illustrated prior art example, the engine 11 is of a live-cylinder, inline type and thus the cylinder block 12 is formed with five, inline cylinder bores. Pistons, which are not shown, are slidably supported in the cylinder bores and are connected to a crankshaft that is rotatably journaled in a crankcase assembly by connecting rods, none of which structure is illustrated inasmuch as it is well known.

A first intermediate shaft 15 is journaled within a chamber formed at one side of the cylinder block and which has an exterior surface 16 that receives a closure plate so as to enclose this chamber. This first intermediate shaft has a gear 17 formed on it that is in mesh with a gear formed on the crankshaft at the throw between the first and second cylinders. This gear arrangement preferably drives the first intermediate shaft 15 at the same speed as the crankshaft.

However, because of the gear drive arrangement, the first intermediate shaft 15 will rotate in an opposite direction from that of the crankshaft. Therefore, there are balance masses 18 and 19 formed on this first intermediate shaft 15 so as to balance some of the unbalanced forces in the engine.

The first intermediate shaft 15 is journaled by bearing surfaces formed in web portions 21 of the surface 16 and by the cover plate attached thereto.

A driving sprocket 22 is affixed on the first intermediate shaft 15 adjacent the gear 17. A chain 23 or other flexible transmitter drive extends upwardly from the sprocket 22 and is entrained with a further sprocket 24 affixed to one end of a second intermediate shaft 25. This second intermediate shaft 25 is journaled in the cylinder head member 14 by suitable bearing surfaces. It should be noted that the sprocket 24 is disposed between the intake port openings 26 of the number 1 and number 2 cylinders.

At least one overhead camshaft 27 is journaled in the cylinder head assembly 13 and has cam lobes 28 for operating valves associated with the respective cylinders. This camshaft has a sprocket 29 affixed to its forward end and which is driven by a sprocket 31 affixed to the forward end of the second intermediate shaft 25 through a flexible transmitter such as a chain 32.

The combined ratio between the sprockets 22 and 24 and 31 and 29 is two-to-one so that the camshaft 27 will be driven at one-half crankshaft speed. Because the reduction need not take place in a single stage, the sprockets 22, 24, 31 and 29 can be smaller than if the reduction was made in a single stage. This permits a more compact engine and since the drive sprocket for the camshaft need not be formed at an end of the crankshaft, the engine can be made shorter in an overall length.

In spite of these advantages, because of the necessity of mounting the second intermediate shaft 25 in the cylinder head, the cylinder head construction becomes rather complicated and costly. This makes the upper portion of the engine more difficult to position in an engine compartment. This is particularly true when low, sloping hood lines are desired.

Therefore, it is the principal object of this invention to provide an improved camshaft driving arrangement that permits the formation of the compact engine but which nevertheless can be simple and use a more conventional type of cylinder head construction.

It is a still further object of this invention to provide an improved and compact cylinder head, cylinder block and camshaft drive arrangement for an internal combustion engine when the camshafts are driven through a pair of intermediate shafts, but neither of them need be mounted in the cylinder head assembly.

SUMMARY OF THE INVENTION

This invention is adapted to be embodied in a camshaft drive arrangement for an engine having a cylinder block having at least one cylinder bore closed by a cylinder head. A crankshaft is driven by a piston contained within the one cylinder bore and which crankshaft rotates about a first axis within the cylinder block. A first intermediate shaft is journaled for rotation by the cylinder block about a second axis that is parallel to the first axis and which is disposed at one side of the crankshaft. First drive means drive the first intermediate shaft from the crankshaft. A second intermediate shaft is journaled for rotation by the cylinder block about a third axis that is parallel to the first and second axes and at a position that is contiguous to the cylinder head.

Second drive means drive the second intermediate shaft from the first intermediate shaft. At least one camshaft is journaled for rotation by the cylinder head about a fourth axis which is parallel to the first, second and third axes for operating at least one valve associated with the cylinder head. A third drive means drives the camshaft from the second intermediate shaft.

DETAILED DESCRIPTION OF THE PREFERRED EMBODIMENT

Figure 1:
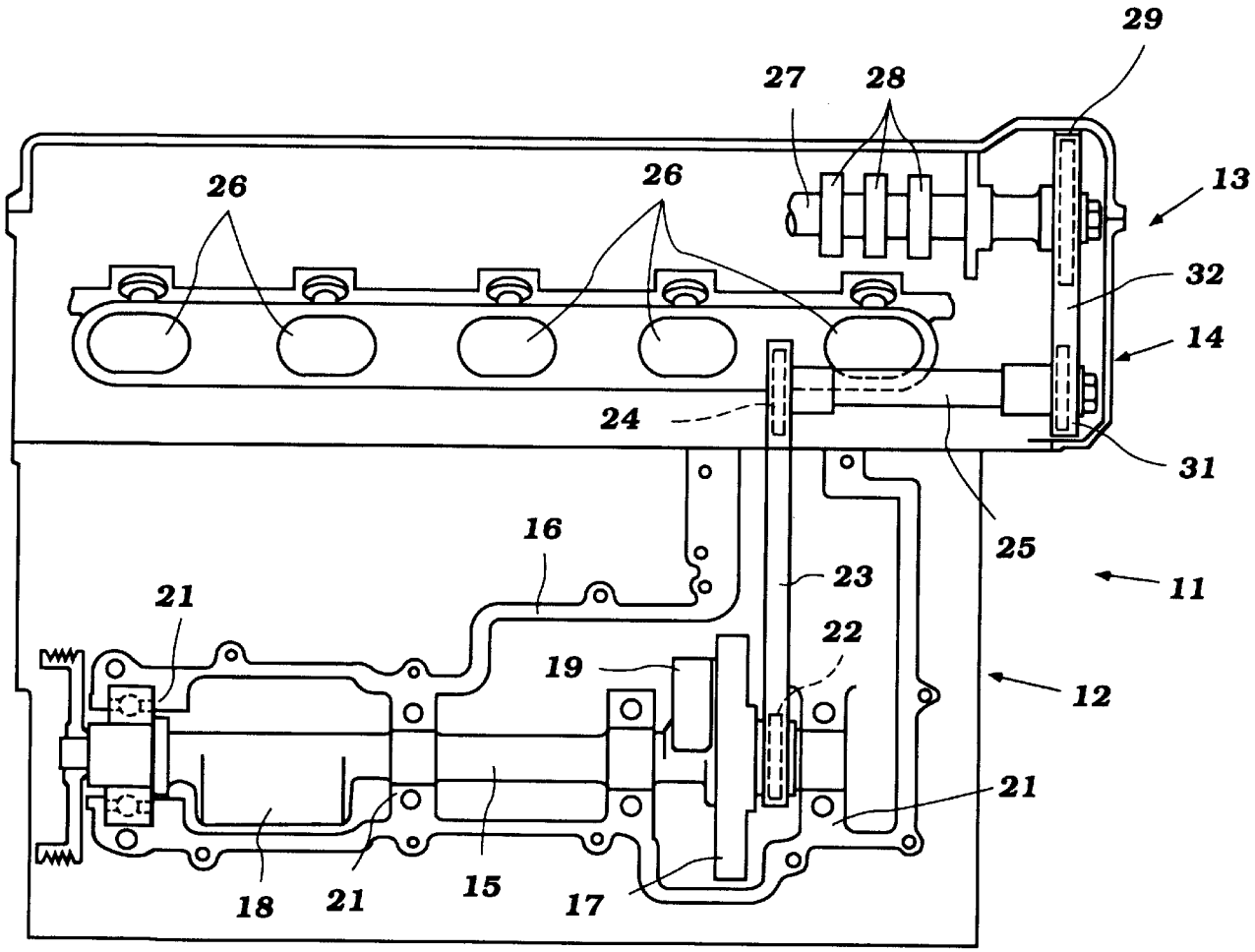
Figure 1 Prior Art
FIG. 1 is a partial side elevational view of an internal combustion engine constructed in accordance with a prior art type of construction with the cam cover and intermediate shaft drive cover removed so as to more clearly show the construction.

Referring now in detail to the drawings, an internal combustion engine constructed in accordance with an embodiment of the invention is indicated generally by the reference numeral 51. Like the description of the prior art engine in FIG. 1, the illustrated embodiment of the invention is not a complete drawing of the engine. Since the invention deals primarily with the camshaft drive arrangement, only these components have been shown in detail. Therefore, where any components of the engine 51 are not illustrated, they may either be considered to be conventional or of a structure as shown in the aforenoted U.S. Pat. No. 5,134,144.

The engine 51 is comprised of a cylinder block assembly 52 and a cylinder head assembly 53 that is detachably connected thereto. The cylinder block assembly 52 forms a number of aligned cylinder bores and the like the prior art type of construction, the engine 51 may be of the five cylinder, inline type.

Pistons contained within the cylinder bores are connected by means of connecting rods to the throws 54 of a crankshaft, indicated generally by the reference numeral 55. The crankshaft 55 has main bearing portions 56 that are suitably journaled within the cylinder block 52 within a crankcase chamber that is closed by a crankcase member which is not shown in the drawing for the aforenoted reasons. At least some of the throws 54 are counter-balanced at least in part by a counter-weight portions 57.

Figure 3:
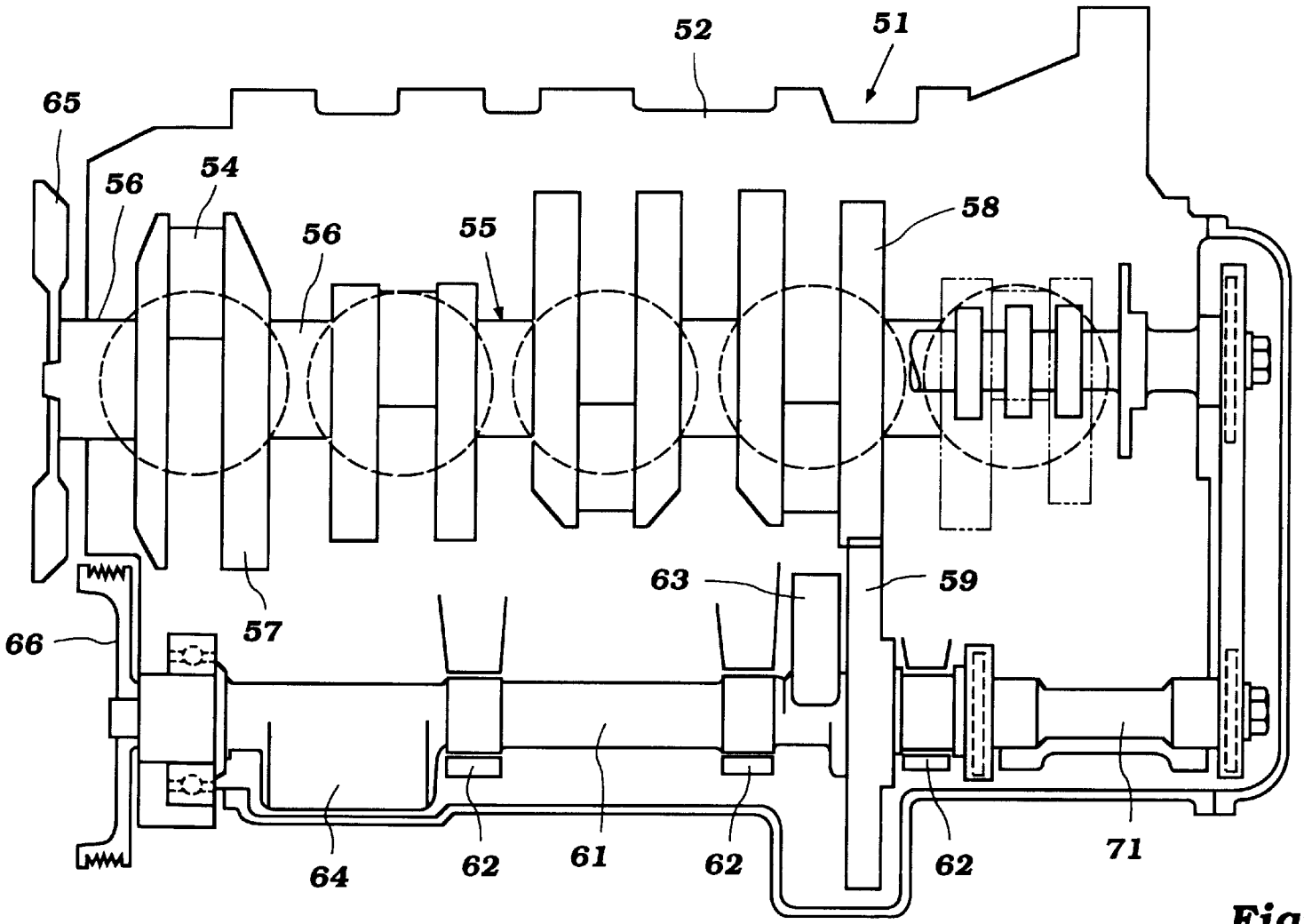
FIG. 3 is a top plan view showing the relationship between the crankshaft, the camshaft and the intermediate shaft.

A timing gear portion 58 is formed on one of the throw portions of the number 2 cylinder, adjacent the number 1 cylinder as best seen in FIG. 3. This timing gear 58 is in-meshed with a timing gear 59 that is affixed to a first intermediate shaft 61.

This first intermediate shaft 61 is journaled within a side cavity formed in the cylinder block member 52 by means that include a plurality of spaced bearings 62. The bearings 62 may be formed by bearing surfaces formed in the cylinder block 52 and bearing caps affixed thereto. The first intermediate shaft 61 also functions as a balance shaft. To this end, balance masses 63 and 64 are formed adjacent the opposite front and rear ends of the first intermediate shaft 61.

The first intermediate shaft 61 extends through a rear face of the cylinder block 52 adjacent a main flywheel 65 of the engine, which flywheel is fixed to the crankshaft 55. A drive pulley 66 is affixed to this end of the first intermediate shaft 61 and can drive one or more engine accessories off of a relatively low position on the engine.

Figure 4:
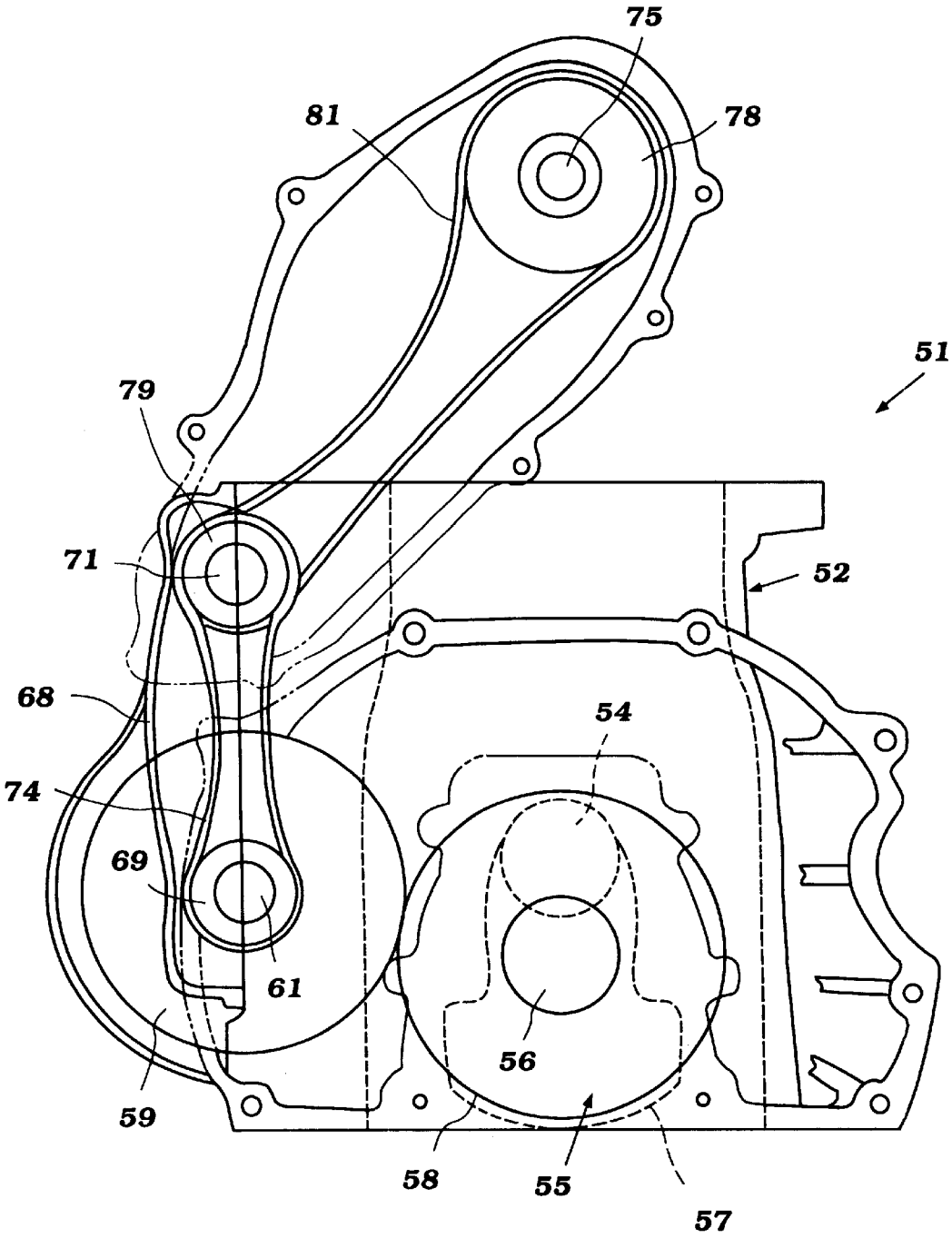
FIG. 4 is a front elevational view of the engine with the front cover removed and the cylinder head shown only partially in order to further illustrate the camshaft drive arrangement.

Like the prior art type of construction, the first intermediate shaft 61 is positioned in the cavity formed in the cylinder block 52. This cavity defines an opening through the side of the cylinder block 52 which has an outer face 67 to which a cover plate 68 (FIG. 4) is affixed.

Figure 2:
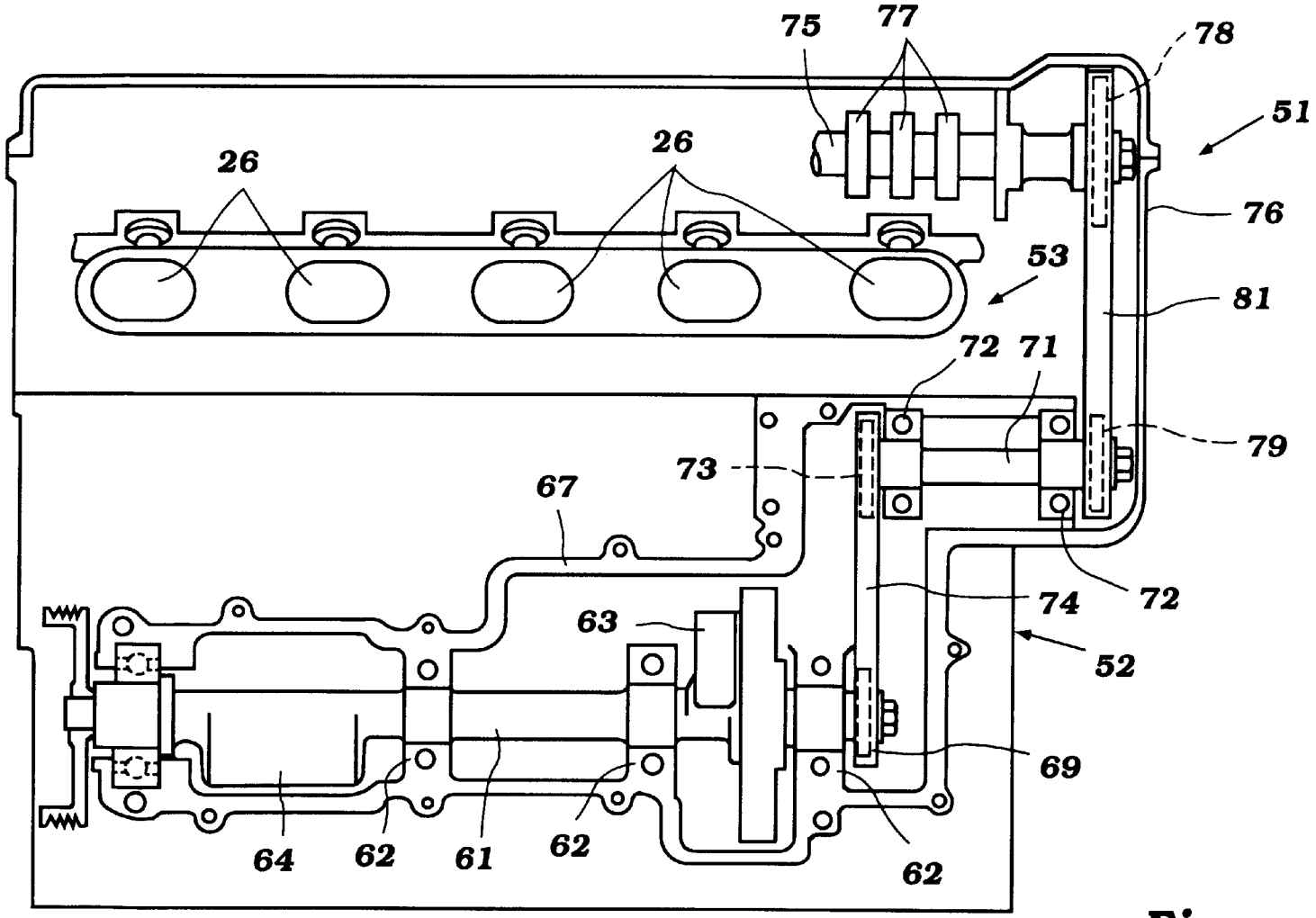
FIG. 2 is a side elevational view, in major parts similar to FIG. 1, but shows the construction in accordance with an embodiment of this invention.

A drive sprocket 69 is affixed to the forward end of the first intermediate shaft 61. As best seen in FIG. 2, this first intermediate shaft 61 does not extend to the full forward end of the cylinder block 52.

Rotatably journaled in the cylinder block 52 about the axis of rotation parallel to those of the crankshaft 56 and the first intermediate shaft 61 is a second intermediate shaft 71. The second intermediate shaft is journaled in the upper end of the cylinder block cavity by means that include integral bearing elements 72 as seen in FIG. 2.

A driven sprocket 73 is affixed to the rear end of this second intermediate shaft 71 and is driven from the first intermediate shaft sprocket 69 by a first flexible transmitter such as a driving chain 74. A tensioner (not shown) may be associated with the chain 74 for maintaining the appropriate tension on it.

At least one overhead camshaft 75 is rotatably journaled in a cylinder head member 76 of the cylinder head assembly 53. This camshaft 75 has a plurality of cam lobes 76 for operating valves associated with each of the cylinders. The camshaft 75 may be a single overhead camshaft for a single overhead camshaft engine, or may be either the intake or exhaust camshaft of a double overhead camshaft engine. In the latter case, the remaining camshaft may be driven by the same drive as that for the camshaft 75 now to be described.

A driving sprocket 78 is affixed to the forward end of the camshaft 75. In a like manner, a driving sprocket 79 is affixed to the forward end of the second intermediate shaft 71. A flexible transmitter such as a timing chain 81 interconnects the driving and driven sprocket 79 and 78 so as to drive the camshaft 75. Again, a tension (not shown) may be provided for maintaining the desired tension in the drive chain 81.

Thus, it should be seen that, by comparing FIG. 2 to FIG. 1, the cylinder head assembly associated with this invention is much simpler than the prior art construction and thus provides further compact construction of the engine. It is also particularly important to maintain a small cylinder head assembly because the modern styling desire is to keep low hood lines and still maintain good accessibility for the engine components. This type of driving arrangement provides these results. Also, like the prior art construction, since the step down in speed from the crankshaft to the camshaft is accomplished in two stages, smaller sprockets can be employed and utilized with the prior art.

Thus, it should be readily apparent to those skilled in the art that the described construction achieves the goals set out for it. Of course, this construction is that of a preferred embodiment of the invention and various changes and modifications may be made without departing from the spirit and scope of the invention, as defined by the appended claims.

What is claimed is:

1. A camshaft drive arrangement for an engine having a cylinder block having at least one cylinder bore closed at an end face of said cylinder block by a cylinder head, a crankshaft driven by a piston contained within said one cylinder bore for rotation about a first axis, a first intermediate shaft journaled for rotation by said cylinder block about a second axis parallel to said first axis and at one side of said crankshaft, first drive means for driving said first intermediate shaft from said crankshaft, a second intermediate shaft journaled for rotation by said cylinder block about a third axis parallel to said first and said second axes, said third axis and said second intermediate shaft lying completely on the side of said cylinder block end face opposite to said cylinder head and at a position adjacent to said cylinder head, second drive means comprising a flexible transmitter for driving said second intermediate shaft from said first intermediate shaft, a camshaft journaled for rotation by said cylinder head about a forth axis parallel to said first, said second and said third axes for operating at least one valve associated with said cylinder head, and third drive means for driving said camshaft from said second intermediate shaft.

2. The engine camshaft drive as set forth in claim 1, wherein the third drive means comprises a flexible transmitter.

3. The engine camshaft drive as set forth in claim 1, wherein the first intermediate shaft is provided with at least one balancing mass thereon for balancing balanced forces of the crankshaft.

4. The engine camshaft drive as set forth in claim 3, wherein the first intermediate shaft has a portion extending beyond the cylinder block and further including an accessory drive pulley affixed to the extending end.

5. The engine camshaft drive as set forth in claim 1, wherein the engine has a plurality of cylinders and the first drive means is disposed between two of the cylinders of the engine and drives the first intermediate shaft at a point adjacent one of its ends.

6. The engine camshaft drive as set forth in claim 5, wherein the first intermediate shaft is substantially shorter than the crankshaft and the second intermediate shaft is substantially shorter than the first intermediate shaft.

7. The engine camshaft drive as set forth in claim 5, wherein the flexible transmitter of the second drive means lies at a side of the cylinders.

* * * * *

UNITED STATES PATENT AND TRADEMARK OFFICE

CERTIFICATE OF CORRECTION

PATENT NO. : 6,199,525 B1
DATED : March 13, 2001
INVENTOR(S) : Hitosho Uema & Yuichi Asano It is certified that error appears in the above-identified patent and that said Letters Patent is hereby corrected as shown below:

Column 1,
Line 53, delete "live-cylinder" and insert -- five-cylinder --.

Column 6, claim 3,
Line 6, delete "balanced" and insert -- unbalanced --.

Signed and Sealed this

Nineteenth Day of February, 2002

*Attest:*

*Attesting Officer*

JAMES E. ROGAN
*Director of the United States Patent and Trademark Office*